US006651776B2

(12) United States Patent
Montecer, Jr.

(10) Patent No.: US 6,651,776 B2
(45) Date of Patent: Nov. 25, 2003

(54) PORTABLE BOAT BOARDING LADDER

(76) Inventor: Claro Montecer, Jr., 907 N. Wilson Ave., #287, Bartow, FL (US) 33830

( * ) Notice: Subject to any disclaimer, the term of this patent is extended or adjusted under 35 U.S.C. 154(b) by 0 days.

(21) Appl. No.: 10/113,719

(22) Filed: Apr. 1, 2002

(65) Prior Publication Data

US 2003/0183452 A1 Oct. 2, 2003

(51) Int. Cl.[7] ..... E06C 1/52; B63B 17/00
(52) U.S. Cl. ..... 182/196; 114/362
(58) Field of Search ..... 182/196, 197, 182/198, 199, 93; 114/362

(56) References Cited

U.S. PATENT DOCUMENTS

| | | | | |
|---|---|---|---|---|
| 2,701,087 A | * | 2/1955 | Trevino | 182/196 X |
| 3,035,286 A | | 5/1962 | Brill | |
| 3,741,340 A | * | 6/1973 | Andrews | 182/196 X |
| 4,186,820 A | | 2/1980 | Cosman et al. | |
| 4,541,507 A | | 9/1985 | Gibellato | |
| 4,572,330 A | | 2/1986 | Langevin | |
| 4,724,925 A | | 2/1988 | Ritten | |
| 5,287,945 A | | 2/1994 | Thurlow | |
| 5,333,323 A | | 8/1994 | Aymes | |
| 6,058,875 A | | 5/2000 | Krish, Jr. | |

* cited by examiner

*Primary Examiner*—Hugh B. Thompson
(74) *Attorney, Agent, or Firm*—Larson & Larson, PA; James E. Larson

(57) ABSTRACT

A pair of substantially parallel lengthwise spaced apart two layered web straps having an attaching device integral at one end of each corresponding web strap. At designated intervals along each web strap, the two layers are spaced apart to form an opening through which a ladder step is inserted at each end of the step. A flanged end cap is removably attached to each end of the ladder step along an outside edge of the web strap. The end caps are removed from the end of the ladder steps and the ladder steps are removed from the straps for compact storage with the straps.

14 Claims, 8 Drawing Sheets

PORTABLE BOAT BOARDING LADDER

BACKGROUND OF THE INVENTION

1. Field of the Invention

This invention relates to boat boarding ladders. More particularly, it refers to a portable small boat boarding ladder having parallel webbed fabric sides connected by removable step bars.

2. Description of the Prior Art

Boat ladders of many descriptions are well known. Most of these prior art ladders are not easily taken apart for carrying in a small luggage bag. The convenience of such a ladder is particularly important with rubber rafts and other inflatable boats that are used for camping and carrying on back packs. The prior art ladders such as shown in U.S. Pat. Nos. 4,186,820; 4,541,507; 4,724,925; 5,333,323 and 6,058,875 all describe small boat ladders, but with metallic side supports that cannot be easily disassembled for compact storage. U.S. Pat. No. 4,572,330 describes a small boat ladder with ladder steps extending between two ladder supports. There is no discernable way for the steps to be detached from the two ladder supports for compact storage. U.S. Pat. No. 5,287,945 describes a small boat ladder with a saddle mounted over a boat's gunnel and a hinged mounting centrally located on the saddle rotatably supporting a tubular ladder. Such an arrangement requires the use of a boarding assist rope. Moreover, the tubular ladder rungs are not detachable from the ladder support.

A need exists for a portable small boat ladder that is compact in storage and stable in use.

SUMMARY OF THE INVENTION

The portable lightweight compact boat ladder of this invention solves the need for an easily taken part and packed ladder useful with small boats, particularly rubber inflatables. The ladder has two substantially parallel spaced apart side members made of a two ply heavy duty web material. About one foot apart, along the length of each side member, there are openings in the web, the openings corresponding with an opening in the corresponding parallel side member. Each end of a cylindrical aluminum step is inserted within the opening in corresponding parallel side members. A flanged end cap is threaded to each end of the aluminum step to retain the step in place. Multiple steps are inserted into the openings in the parallel web members to form the ladder. One end of each parallel side member has an attaching member integrally connected for attaching to a ring structure on the bottom of a boat or inside the gunnel of a boat to retain the ladder in position draped over the gunnel of the boat with the steps descending into the water.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
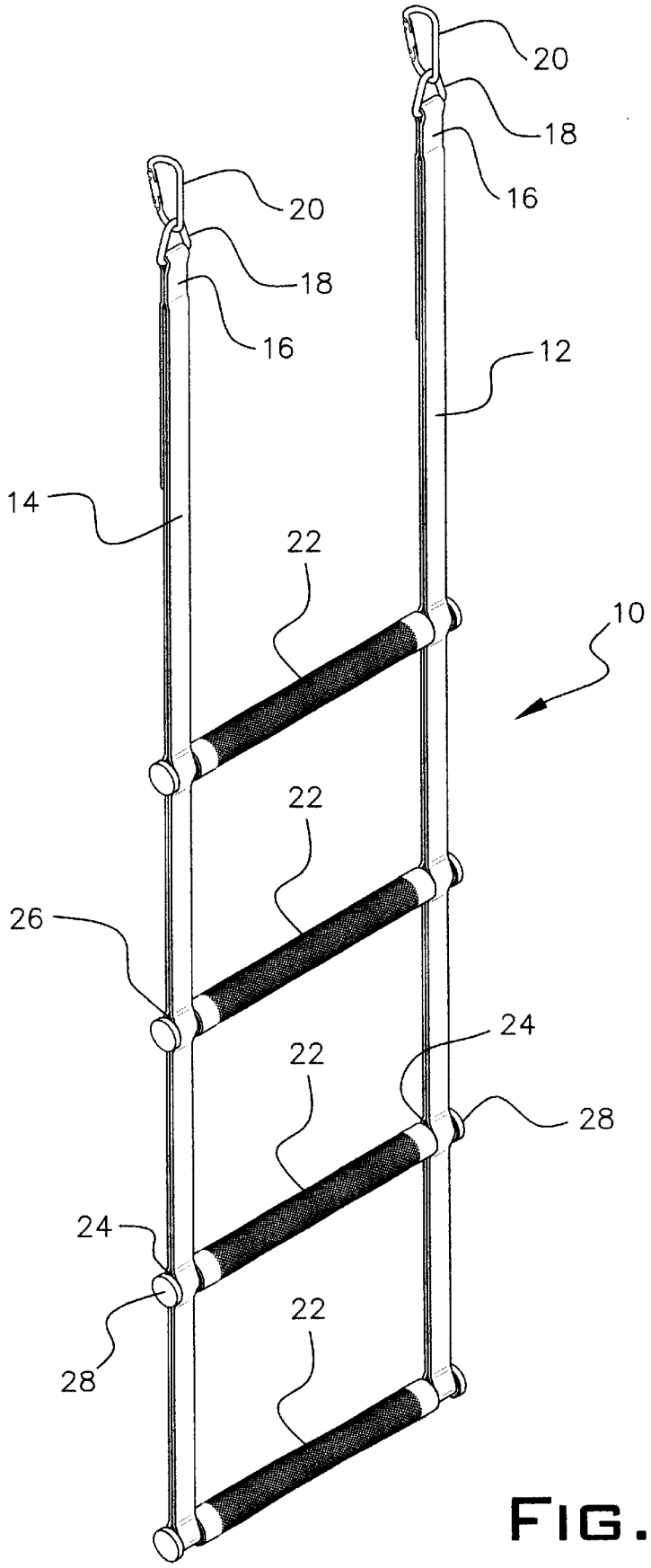
FIG. 1 is perspective view of the boat boarding ladder of this invention.
Figure 2:
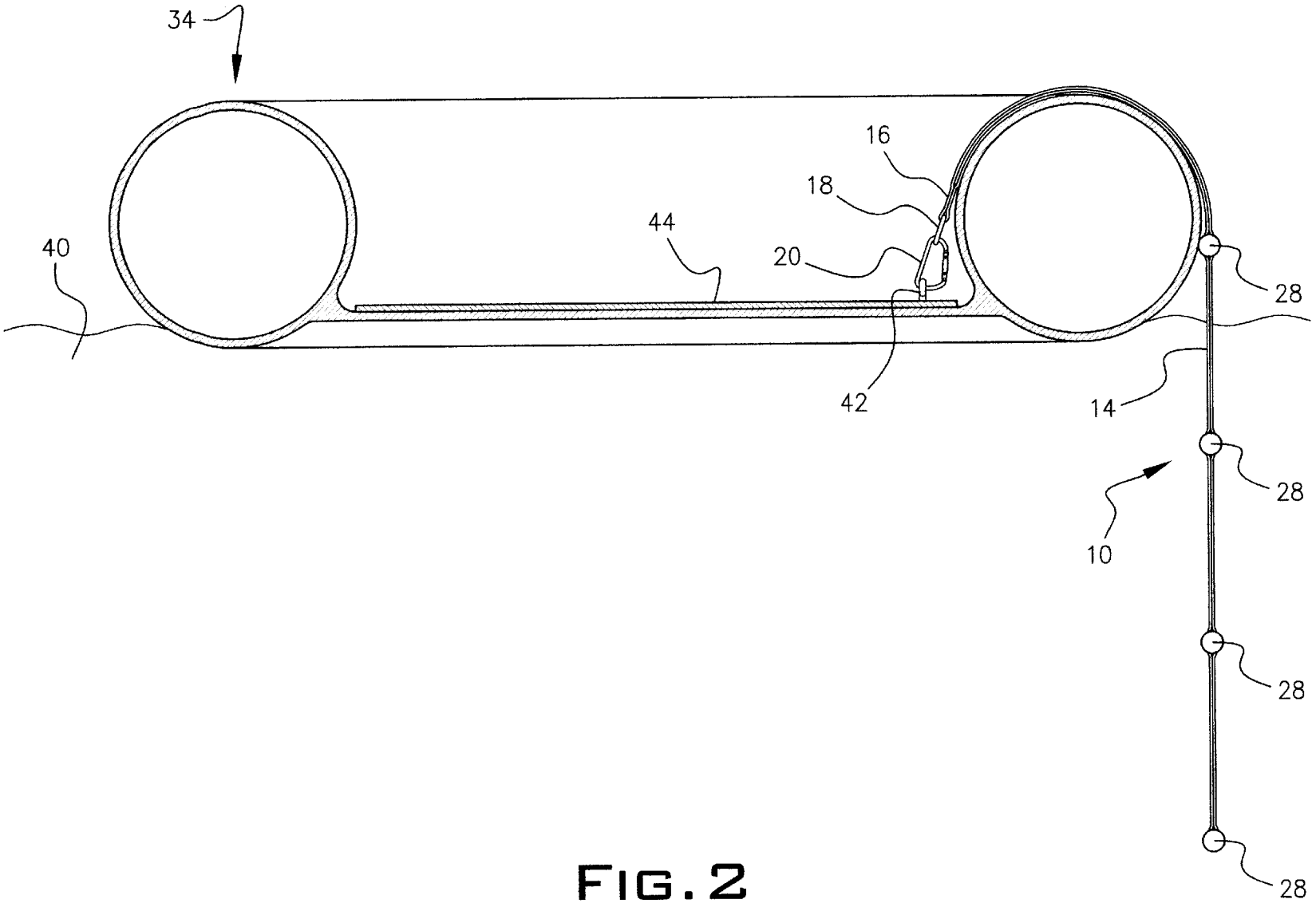
FIG. 2 is a sectional side view in elevation of a rubber raft having the boat boarding ladder attached.
Figure 3:
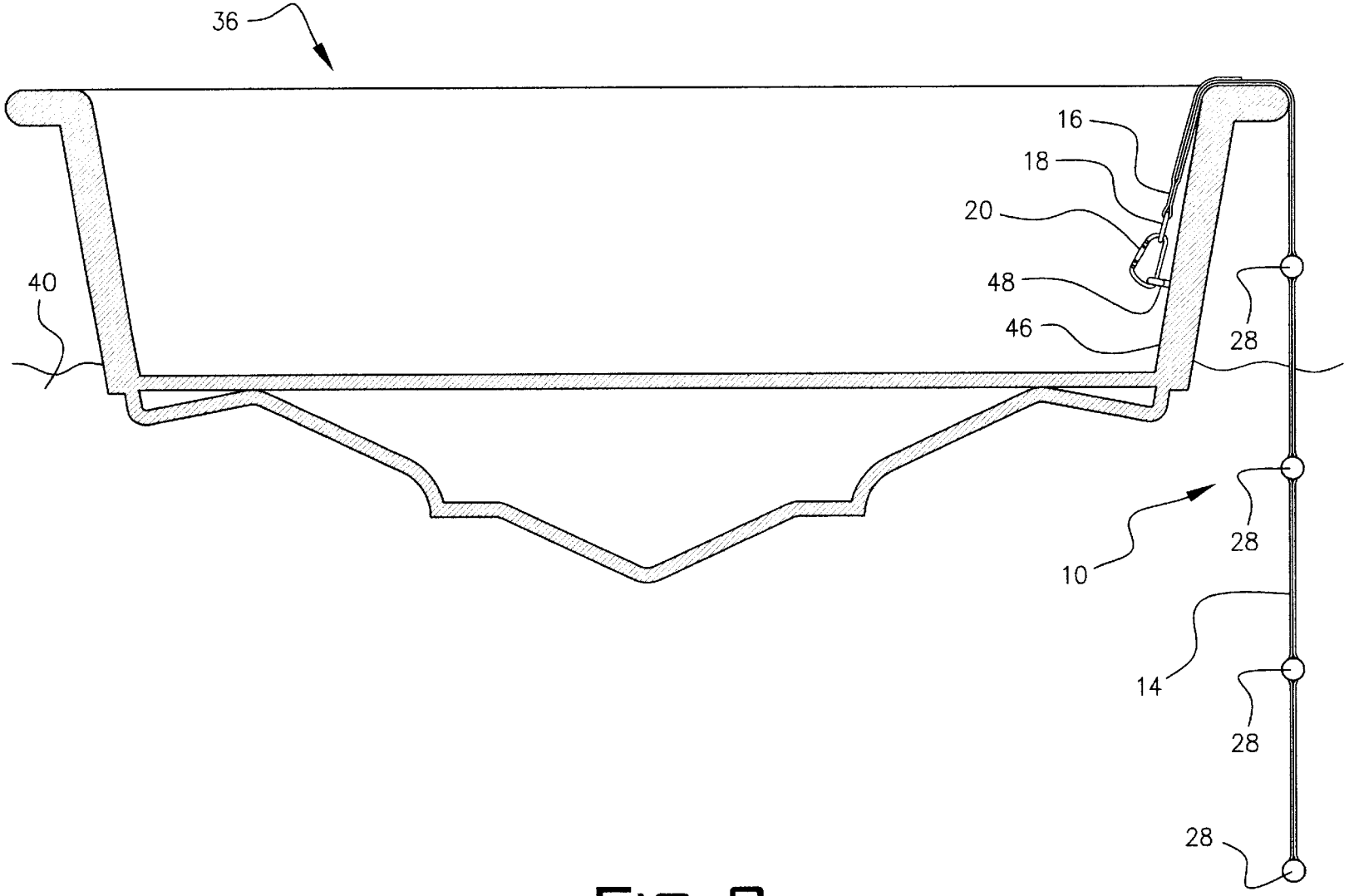
FIG. 3 is a sectional rear view in elevation of a small boat having the boat boarding ladder attached.
Figure 4:
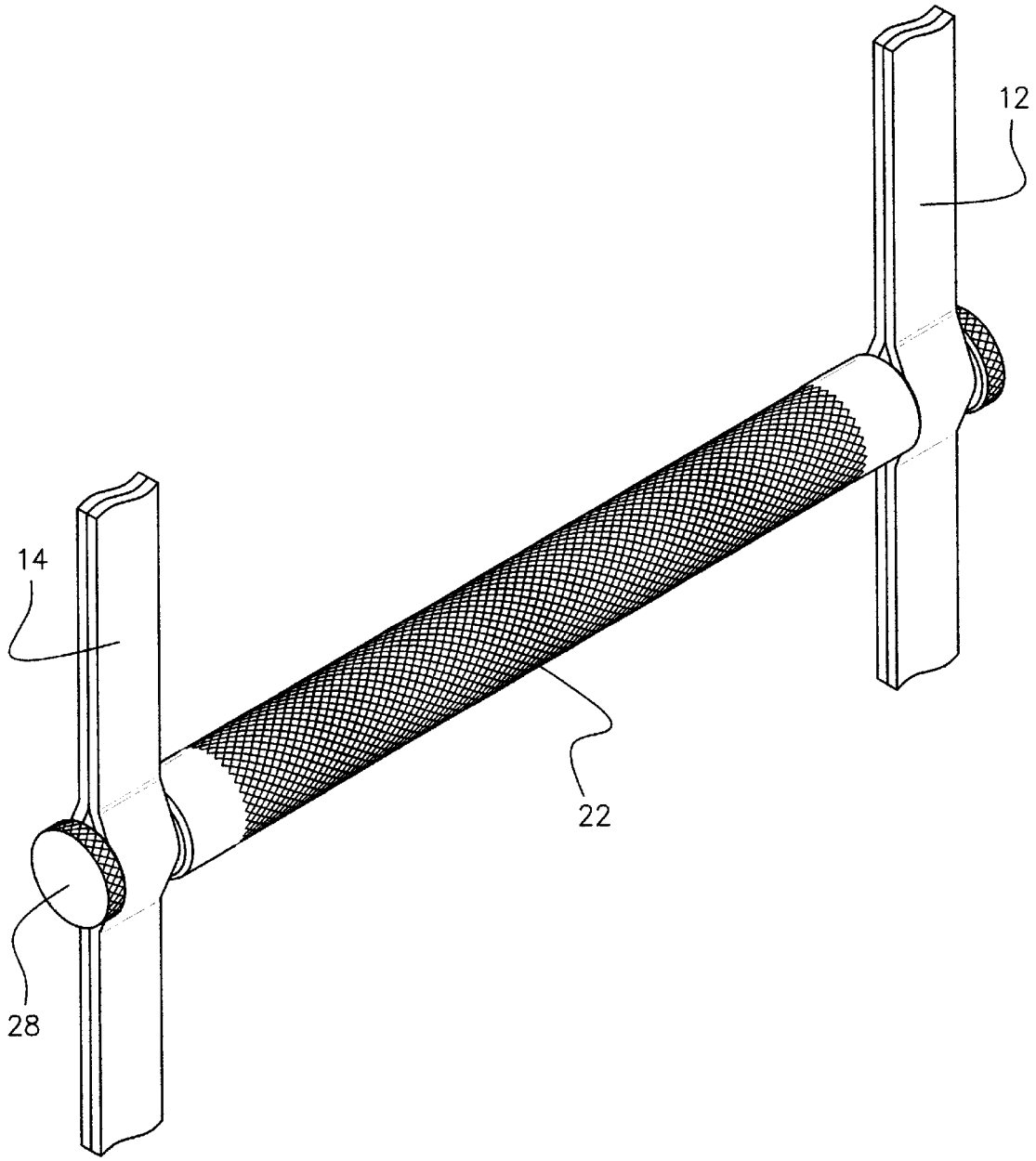
FIG. 4 is a perspective view of a ladder step engaged to parallel side members.
Figure 5:
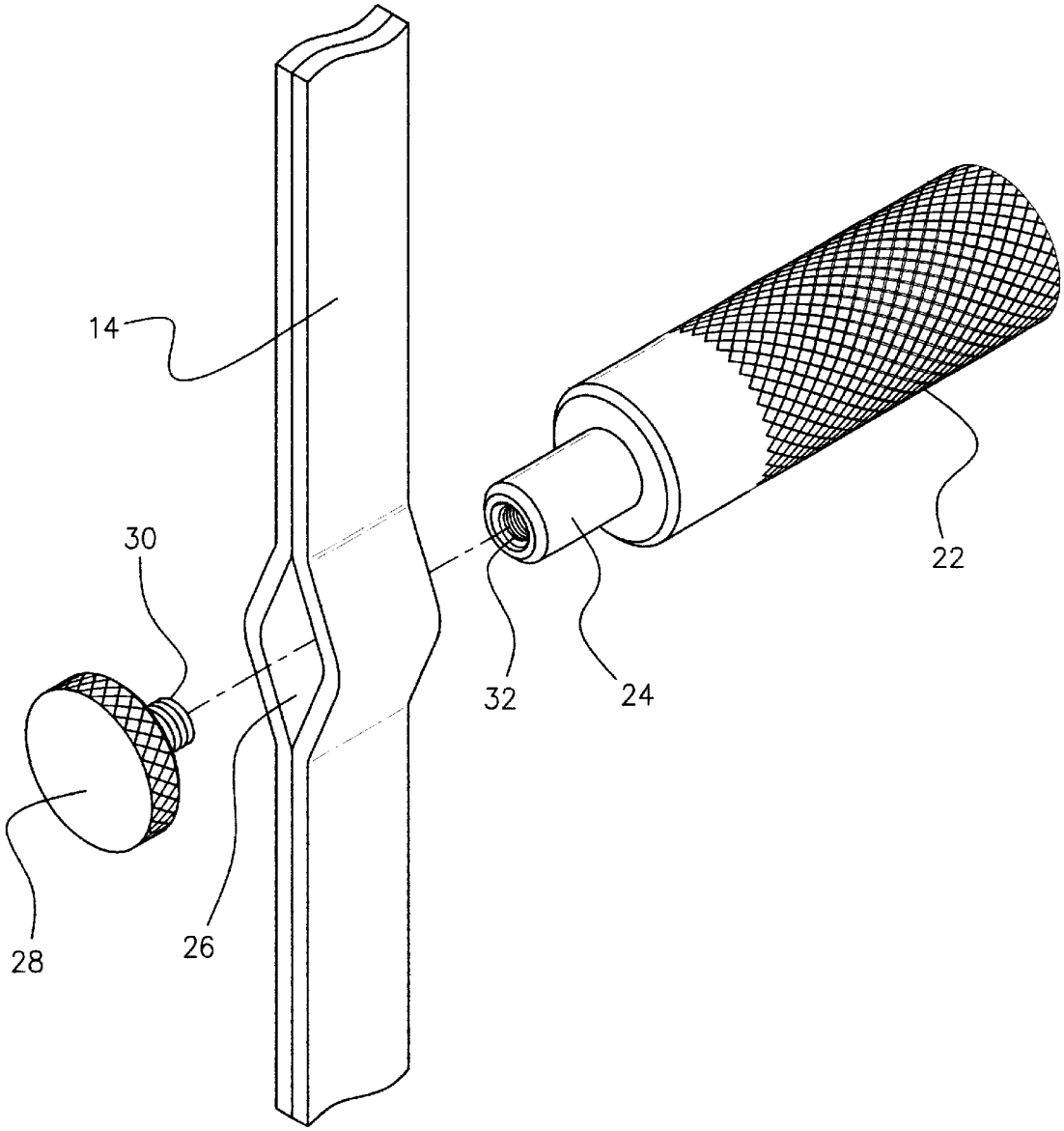
FIG. 5 is an exploded view of a ladder step being removed from a side member.

Throughout the following detailed description, the same reference numerals refer to the same elements in all figures.

Referring to FIG. 1, the portable boat boarding ladder 10 has parallel flexible side members 12 and 14. The side members 12 and 14 are each made of a two ply web material. One end 16 of each side member has an attached integral metal D-ring 18. The D-ring 18 is connected to a snap hook 20 for easy engagement with a ring mounted on the deck or an inside gunnel of a small boat.

Multiple steps 22 are attached to and connect the side members 12 and 14 at comfortable intervals for a person intending to board a small boat. The step 22 has an end shaft 24 that fits into an opening 26 formed by a space between the two ply web material. A flanged end cap 28 has a threaded shaft 30 to screw into corresponding threads 32 in the interior of shaft 24.

Figure 6:
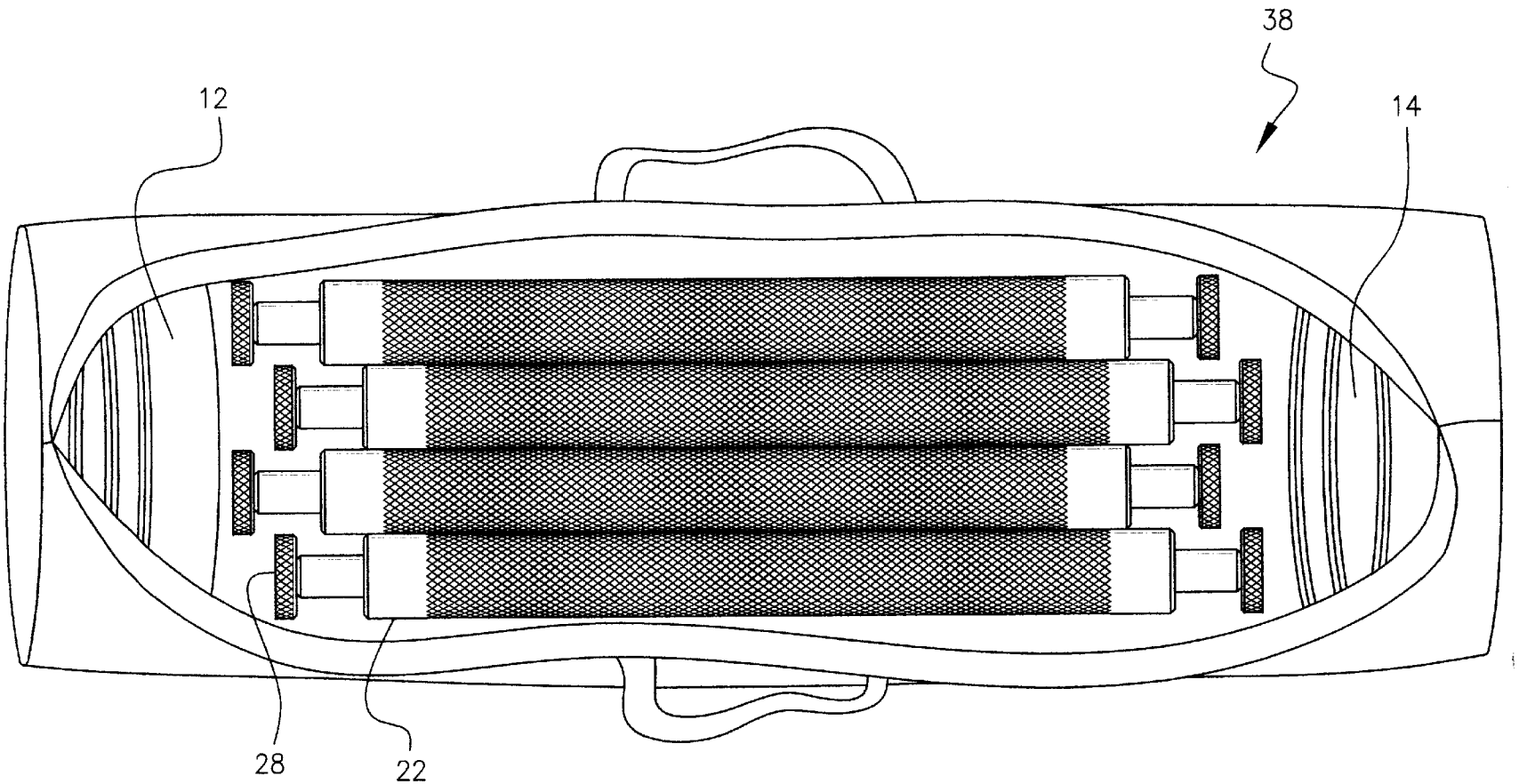
FIG. 6 is a cut away view of a storage bag containing the disassembled components of the boat boarding ladder.

The boarding ladder 10 forms a stable means for a person in the water to come aboard a rubber raft 34 or a small boat 36. At the same time, the steps 22 can be easily disengaged from the side members 12 and 14 by unscrewing cap 28. The side members 12 and 14 can be rolled up and placed in a small carrying case 38. The steps 22, side members 12 and 14 and end caps 28 in a carrying case 38 are shown in FIG. 6. Thus, a camper can carry a rubber boat to a body of water, inflate the boat 34 and engage the ladder steps 22 to the side members 12 and 14, connect snap hook 20 to a deck ring 42, and thereafter, have a ready means for boarding the boat from the water 40. In a rubber boat 34, a deck 44 would contain deck ring 42. In a small boat 36, a gunnel inside surface 46 would contain a ring 48 for connection to snap hook 20.

Figure 7:
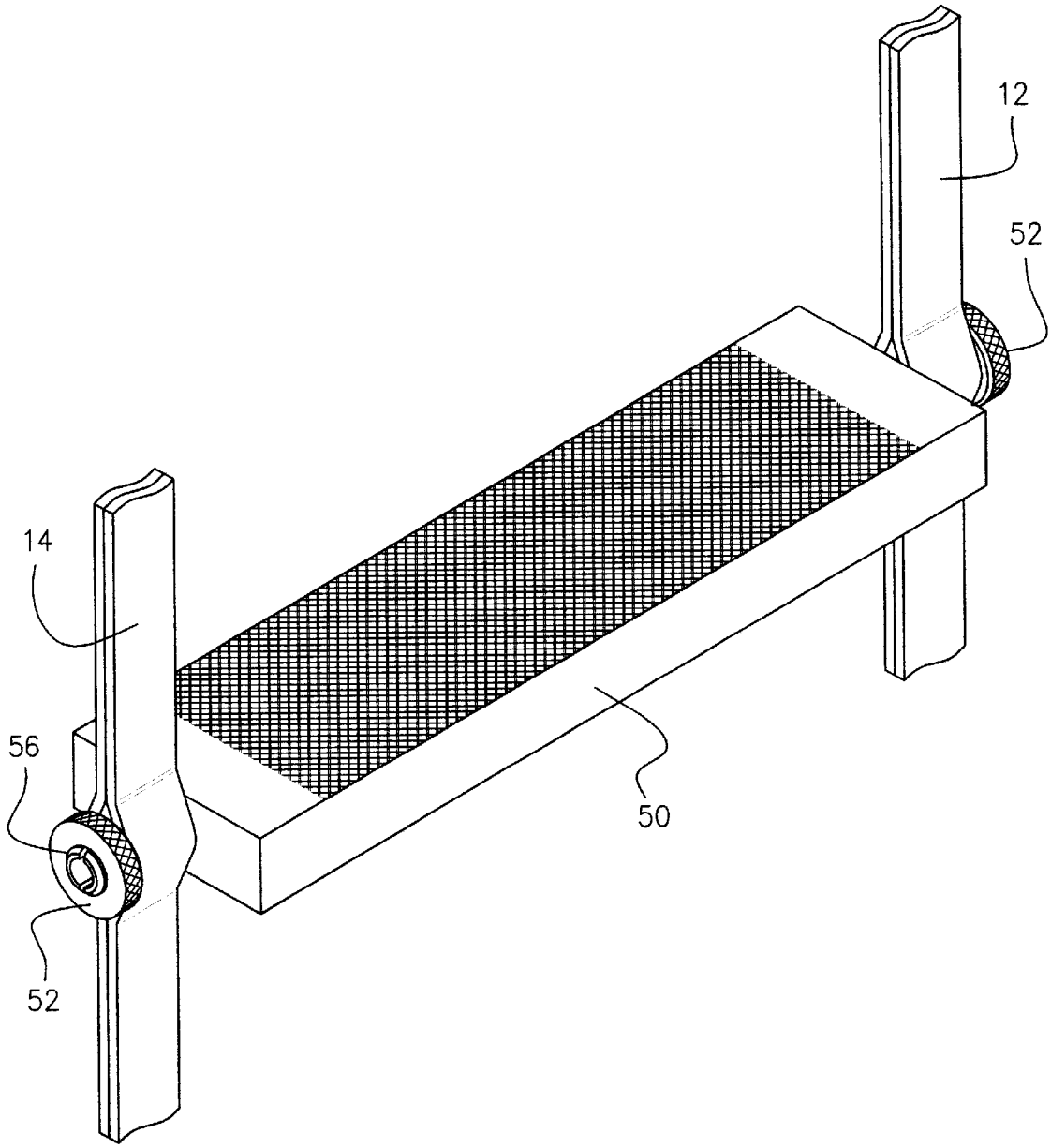
FIG. 7 is a perspective view of an alternate step and end cap for the ladder.
Figure 8:
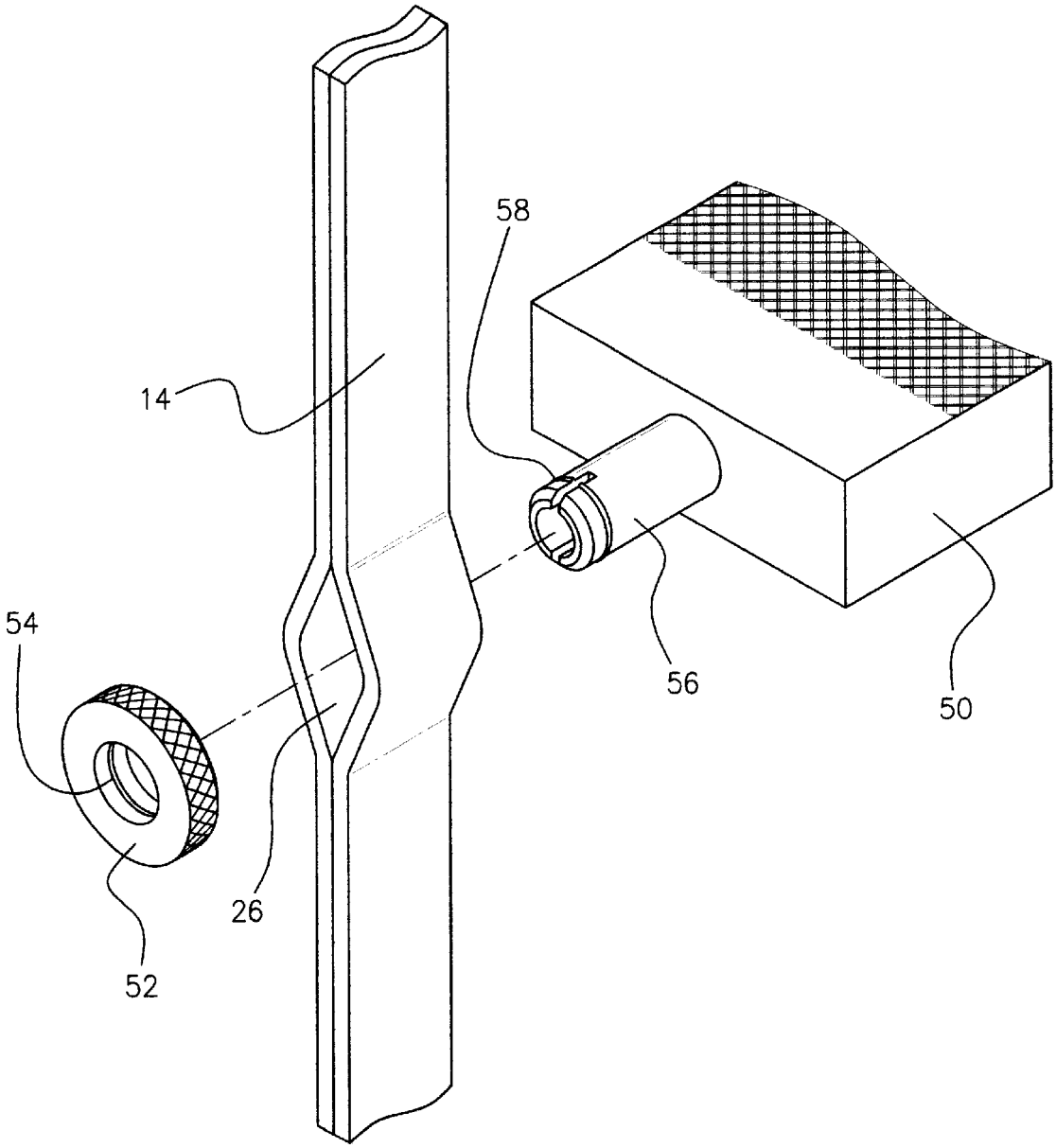
FIG. 8 is an exploded view of the alternate end cap for use with a step.

The steps 22 are made from solid aluminum or stainless steel rods or can be made from a high strength polymer with a weighted insert molded into the polymer to endure that the steps will descend into the water. Although the steps are preferred to be cylindrical in shape, they can have other shapes including a rectangle 50 as shown in FIG. 7, provided the ends of each step 50 have rods 56 or equivalent elements for insertion into opening 26 between the plies of the side members 12 and 14 and have an easily removable end cap 52. The alternate end cap configuration is shown in FIG. 8 where the cap 52 snaps over shaft 56. Shaft 56 is press fit into bore 54 with metal guides 58 depressed. The end cap is removed by pulling outwardly on end cap 52.

The two ply side members 12 and 14 can be made from polypropylene or other flexible high strength polymer. Hemp also can be used to form the web material in side members 12 and 14. Each ply is sewn together to form the high strength web.

The attachment metal D-ring 18 and snap hook 20 are made from stainless steel or other non-rusting high strength metal.

Equivalent elements and components can be substituted for the ones set forth above to achieve the same results in the same manner.

Having thus described the invention, what is claimed and desired to be secured by Letters Patent is:

1. A compact portable small boat ladder comprising:

a first and second parallel two layered flexible web strap extending lengthwise;

a space separating each web layer forming an opening at designated intervals along the first and second web strap, each opening from the first web strap corresponding to an opening in the second web strap;

multiple foot support elements each engaged at a first end through a respective one of the openings in the first web strap and at a second end through a corresponding one of the openings in the second web strap;

a removable flanged cap juxtaposed to each end of each foot support element along an outer edge of the first and second web strap; and a means integrally attached to one end of each corresponding first and second web straps for securely attaching the ladder to the interior of the small boat.

2. The boat ladder according to claim 1 wherein the foot support elements are cylindrical solid aluminum rods.

3. The boat ladder according to claim 1 wherein the foot support elements are cylindrical stainless steel rods.

4. The boat ladder according to claim 1 wherein the foot support elements are cylindrical polymeric rods containing weighted interior members.

5. The boat ladder according to claim 1 wherein the foot support element is a rectangular step having a shaft at each end.

6. The boat ladder according to claim 1 wherein the means for attaching the ladder to the interior of the small boat is a D-ring attached to the end of each side member engaged to a snap swivel.

7. A compact portable small boat ladder comprising:

a pair of substantially parallel spaced apart two ply flexible web straps extending lengthwise;

a space separating each ply at designated intervals along the web straps each space corresponding to a space at the same interval of each strap;

multiple foot support elements, each foot support element having a shaft at each end inserted into the respective space between the plies to connect the web straps at the same interval;

an end cap removably attached to the shaft at each end of each foot support element, the end cap having a flanged portion juxtaposed to an outer edge of the web strap; and a means for securely attaching an end of each strap to an interior of a small boat.

8. The small boat ladder according to claim 7 wherein the foot support elements are cylindrical in shape.

9. The small boat ladder according to claim 8 wherein the foot support elements are solid aluminum rods.

10. The small boat ladder according to claim 8 wherein the foot support elements are stainless steel rods.

11. The small boat ladder according to claim 8 wherein the foot support elements are weighted polymeric rods.

12. The small boat ladder according to claim 7 wherein the ladder in a disassembled state has multiple foot support elements, end caps and the web straps adapted to be coiled in a small carrying bag.

13. The small boat ladder according to claim 7, is adapted to be attached to a deck of a rubber boat.

14. The small boat ladder according to claim 7, is adapted to be attached to an inside gunnel of a small boat.

* * * * *